US006206114B1

(12) United States Patent
McLeod

(10) Patent No.: US 6,206,114 B1
(45) Date of Patent: Mar. 27, 2001

(54) TOOL FOR TRANSPORTING CUTTING MEANS TO AND FROM A GROUND DRILL

(75) Inventor: Gavin Thomas McLeod, Ardross (AU)

(73) Assignee: DHT Technologies, Ltd., Perth (AU)

( * ) Notice: Subject to any disclaimer, the term of this patent is extended or adjusted under 35 U.S.C. 154(b) by 0 days.

(21) Appl. No.: 09/029,395

(22) PCT Filed: Aug. 22, 1996

(86) PCT No.: PCT/AU96/00527

§ 371 Date: Feb. 27, 1998

§ 102(e) Date: Feb. 27, 1998

(87) PCT Pub. No.: WO97/08417

PCT Pub. Date: Mar. 6, 1997

(30) Foreign Application Priority Data

Aug. 28, 1995 (AU) ..... PN5053

(51) Int. Cl.[7] ..... E21B 10/64; E21B 10/66

(52) U.S. Cl. ..... 175/258; 175/257; 175/259; 175/260; 175/273; 175/289

(58) Field of Search ..... 175/260, 261, 175/52, 259, 273, 257, 258, 309, 289, 292

(56) References Cited

U.S. PATENT DOCUMENTS

| | | | | |
|---|---|---|---|---|
| 1,442,188 | * | 11/1923 | Stokes | 175/260 X |
| 2,771,275 | * | 11/1956 | Ortloff | 175/259 |
| 2,829,868 | * | 4/1958 | Pickard et al. | 175/246 |
| 3,097,708 | * | 7/1963 | Kammerer et al. | 175/260 |
| 3,103,981 | * | 9/1963 | Harper | 175/236 |
| 3,321,017 | | 5/1967 | Young | 166/135 |
| 3,346,059 | * | 10/1967 | Svendsen | 175/246 |
| 3,437,159 | * | 4/1969 | Link et al. | 175/260 |
| 3,461,981 | * | 8/1969 | Casper et al. | 175/246 X |
| 3,603,411 | * | 9/1971 | Link | 175/259 |
| 3,871,487 | * | 3/1975 | Cooper et al. | 175/257 X |
| 4,181,344 | | 1/1980 | Gazda | 294/86.18 |
| 4,828,023 | * | 5/1989 | Leggett | 166/72 |
| 5,074,355 | * | 12/1991 | Lennon | 166/55.1 |
| 5,662,182 | | 9/1997 | McLeod | 175/258 |
| 5,743,344 | * | 4/1998 | McLeod et al. | 175/258 |
| 5,785,134 | * | 7/1998 | McLeod et al. | 175/258 |
| 5,799,742 | * | 9/1998 | Soinski et al. | 175/236 |
| 5,813,481 | * | 9/1998 | McLeod et al. | 175/259 X |
| 5,954,146 | * | 9/1999 | McLeod et al. | 175/257 |

OTHER PUBLICATIONS

Derwent Abstract No. 87–161367/23, SU1263804–A (W–Kaza Goetech Comp) Oct. 15, 1986.

* cited by examiner

*Primary Examiner*—Eileen D. Lillis
*Assistant Examiner*—Jong-Suk Lee

(57) ABSTRACT

A down hole running tool 14 travels in a first direction through a drill pipe for installing bit segments 18 at the end of a drive sub 12 attached to the drill pipe. The tool 14 includes a first portion 82 and a second portion 84 which is retractably coupled to a leading end of the first portion 82. The first portion 82 includes a tubular extension 134 which receives a spigot 136 that extends from an upper end of the second portion 84. A pin 138 extends transversely through the tubular extension 134 and resides within opposing slots 140 formed in the spigot 136. There is a stepped reduction in the internal diameter at the lower end of the tubular extension 134 so as to form a cup-like structure 146. A spring 168 is disposed about the spigot 136 and has an upper end seated in the cup-like structure 146 and a lower end bearing against an upper face 170 of the second portion 84. The spring 168 is biased so as to push the first and second portions 82 and 84 apart in the longitudinal direction. When the tool 14 is lowered into the drive sub 12 and the second portion 84 hits a stop, the first portion 82 is able to continue movement for a short distance against the bias of the spring 168 by virtue of a gap existing between the surface 170 and the end of the cup-like structure 146.

11 Claims, 12 Drawing Sheets

TOOL FOR TRANSPORTING CUTTING MEANS TO AND FROM A GROUND DRILL

FIELD OF THE INVENTION

The present invention relates to a tool and, in particular, but not exclusively, to a tool for use in a system for in situ replacement of cutting means for a ground drill.

BACKGROUND OF THE INVENTION

A system for in situ replacement of cutting means for a ground drill is described in Applicant's International application no. PCT/AU94/00322 (WO 94/29567), the contents of which are incorporated herein by way of reference. The system in WO 94/29567 comprises a drive sub which is adapted for connection to a lower end of a core barrel attached to a drill pipe; a tool for installing and retracting drill bit segments from the drive sub; and, an insert or bit locking sleeve for selectively locking the bit segments into seats provided about the inner circumferential surface of an end of the drive sub and subsequently releasing the bit segments for those seats. The tool includes a main body portion and a sleeve slidably mounted thereon. Installation latch dogs provided in the tool extend from apertures or slots cut in the sleeve so as to engage the bit locking sleeve and force it into an installation position in which it locks the bit segments in a cutting position about the drive sub. The tool further includes retrieval latch dogs which can extend from different slots provided in the sleeve for engaging the bit locking sleeve and pulling it upwardly into a retrieval position in which the bit segments can be retrieved from the drive sub.

A slidable cradle extends from a lower end of the tool for carrying the bit segments to and from the drive sub. When installing the bit segments, the cradle is extended from the lower end or head of the tool against the bias of a spring. Bit segments are held by rubber bands about the cradle with one end abutting a stop provided at one of the cradle and an opposite end bearing against the head of the tool. When the tool is lowered into the ground drill (comprising the combination of the drill tube, core barrel and drive sub) and reaches a predetermined position within the drive sub (that being the point of engagement with the bit locking sleeve), the sleeve is caused to move relative to the main body of the tool which in turn releases a set of pins holding the spring about the cradle in compression. This fires the cradle so that the spring is able to expand, retracting the cradle into the main body of the tool which causes an upper end of the bit segment to slide along the head of the tool so as to extend laterally of the outer periphery of the tool. The bit locking sleeve is simultaneously pushed by the tool so as to catch the ends of and move inside the drill bit segments thereby expanding the drill bit segments to the inner diameter of the drive sub and locking the drill bit segments in the cutting position.

When lowering the tool into the ground drill the tool is initially placed within a transport sleeve which acts to compress the installation latch dogs to prevent catching on internal surfaces of the drill tube prior to entering a core barrel and the drive sub. A landing ring is provided between the core barrel and drill tube of a diameter which prevents further progress of the transport sleeve but allows the tool to pass therethrough. The transport sleeve sits on the landing ring and, after installation or retrieval of the cutting means again carries the tool once pulled from beneath the landing ring to the surface.

Field trials of the above system have proved very successful. Nevertheless, it is thought that there is a potential for various problems to arise under extreme operational conditions.

One potential problem with the above system of WO 94/29567 is that due to the relative lengths and configurations of the tool and the bit locking sleeve, when the tool bottoms out, that is, reaches the very end of its travel within the ground drill and stops, the bit locking sleeve may sit several millimetres above an abutment surface formed on the radially inner surface of the bit segments against which, ideally the bit locking sleeve should contact. When this contact is achieved, the maximum clamping force of the bit locking sleeve and bit segments against the inner surface of the drive sub is obtained. It is thought that there is a possibility of the bit locking sleeve effectively working its way loose under the influence of severe and sustained vibration when not disposed in direct contact with the abutment surface of the bit segments.

SUMMARY OF THE INVENTION

It is an object of the present invention to improve the tool of the above system which can push the bit locking sleeve further down into the drive sub.

According to the present invention there is provided a tool for transporting bit segments to and from a drive sub of a ground drill and for moving a bit locking sleeve held within the drive sub to an installation position in which the bit locking sleeve can lock the bit segments against an inner surface of the drive sub, said tool further adapted to cooperate with stopping means disposed within said drive sub for stopping the travel of said tool in a first direction, the tool comprising:

- a first portion;
- a second portion retractably coupled to a lower end of said first portion; and,
- means carried by said first part for engaging said bit locking sleeve;
- whereby, in use, when said tool travels in said first direction, said means initially engages said sleeve to move said sleeve toward said installation position and on further travel in said first direction a leading end of said tool engages said stopping means to halt travel of said leading end causing one portion to retract into the other portion enabling further movement of the first portion in the first direction so that said engaging means can move said bit locking sleeve fully into said installation position.

Preferably said first and second portions are resiliently coupled together so that after initial retraction of one of said portions into the other, said portions tend to move away from each other to restore said tool to an equilibrium state.

Preferably an upper end of said second portion is connected to a lower end of said first portion to allow relative movement of said first and second portions in the direction of the length of said tool.

Preferably said first and second portions are provided with respective abutment surfaces adapted to abut each other when said tool hits said stopping means and said one portion retracts into said other portion by a predetermined distance thereby limiting the further movement of said first portion in said first direction.

Preferably said tool further comprises a resilient element retained between said first and second portions acting so as to push said first and second portions away from each other.

Preferably said first portion at said lower end is provided with a first member and said second portion at said upper end is provided with a second member, said members being relatively dimensioned so that one of said members can fit and slide with the other member so as to allow one of said portion to retract into the other portion.

Preferably one of said members is provided with at least one slot which is elongated in the first direction and further comprising means which is coupled to the other member and extends into said at least one slot thereby coupling said first and second portions together.

Preferably said resilient means is retained in a recess formed between said first and second members.

Preferably said first member is tubular in form and said second member slidingly fits within said first member.

Preferably a portion of the length of an interior surface of said first member and/or an exterior surface of said second member is cut out to form said recess for retaining said resilient means.

Preferably said tool is adapted for transporting cutting means to and from a ground drill, said ground drill defining said conduit, said tool further adapted to travel through said ground drill and to corporate with a cutting means locking sleeve disposed in said ground drill, said locking sleeve movable into an installation position in which said cutting means is retained in a cutting position between said locking sleeve and an inner circumferential surface of said ground drill, said tool further comprising latching means provided in said first part adapted for engaging said locking sleeve for pushing said locking sleeve toward said installation position, wherein, when said tool engages said stopping means, said first portion continues to move in the first direction of travel of said tool and thereby pushes said locking sleeve further into said installation position.

BRIEF DESCRIPTION OF THE DRAWINGS

An embodiment of the present invention will now be described by way of example only, with reference to the accompanying drawings in which.

DETAILED DESCRIPTION OF THE PREFERRED EMBODIMENT

Figures 1, 5, 11:
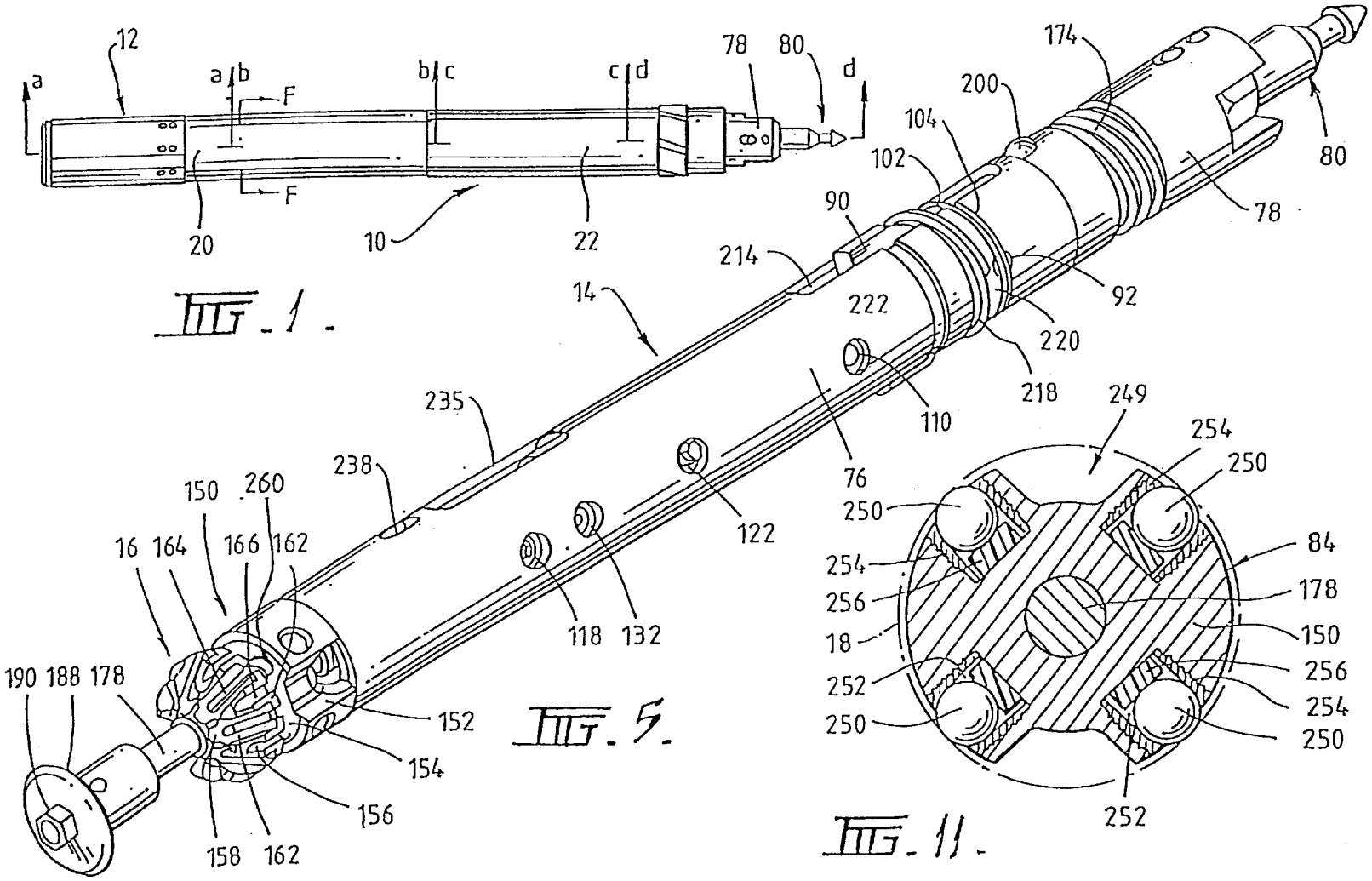
FIG. 1 is a longitudinal side view of a system for in situ replacement of cutting means for a ground drill.
FIG. 5 is a perspective view of the tool incorporated in the system for in situ replacement of cutting means in a ground drill shown in FIGS. 1 to 4.

In the following description, an embodiment of the tool in accordance with this invention will be described in relation to a complete system for the in situ replacement of cutting means for a ground drill. However, it is to be understood that the tool is not limited only to use in a system for the in situ replacement of cutting means in a ground drill.

Referring to the accompanying drawings, and, in particular, to FIGS. 1–7, it can be seen that a system 10 for the in situ replacement of cutting means for a ground drill comprises a number of separate but interactive components including a drive sub 12 (refer in particular to FIG. 6) adapted for connection to a lower end of a core barrel 26 (shown in FIGS. 9 and 10); a installation and retrieval tool 14 (refer in particular to FIG. 5) which is dimensioned to travel through the ground drill for carrying cutting means in the form of drill bit segments 16 (refer in particular to FIGS. 1*a*, 1*b*, 1*c*, 1*d*, 4*a*, 4*b*, 4*c* and 4*d* ) to and from the drive sub 12; and, a substantially cylindrical bit locking sleeve 18 (refer in particular to FIG. 7) which is slidably retained within the drive sub 12 between an installation position (shown in FIGS. 3*a* to 3*d* and 4*a* to 4*d*) in which the locking sleeve retains the bit segments 16 in a cutting position at the end of the drive sub 12 and, a retrieval position (shown in FIGS. 1*a* to 1*d* and 2*a* to 2*d*) in which the bit locking sleeve 18 is disposed above the end of drive sub 12 to allow the release of the bit segments 16.

Figure 6:
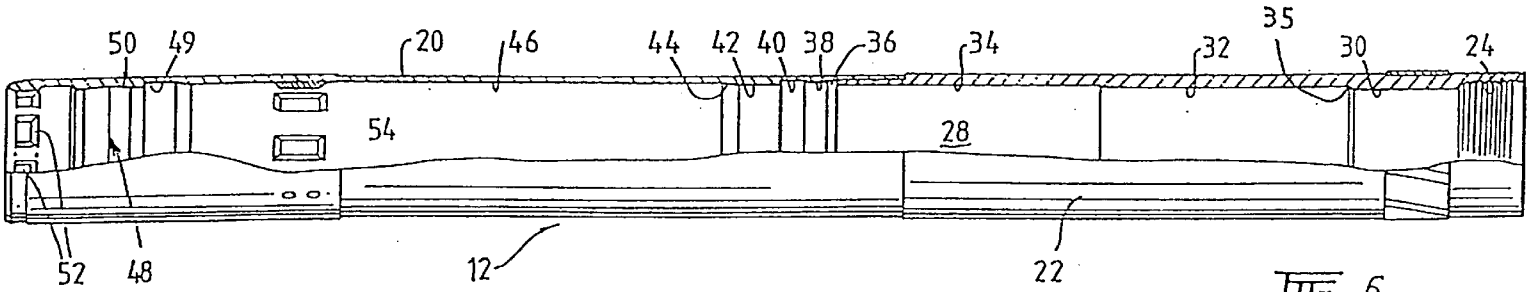
FIG. 6 is a longitudinal-sectional view of a drive sub incorporated in the system for in situ replacement of cutting means in a ground drill which cooperates with the compression system.
Figure 7:
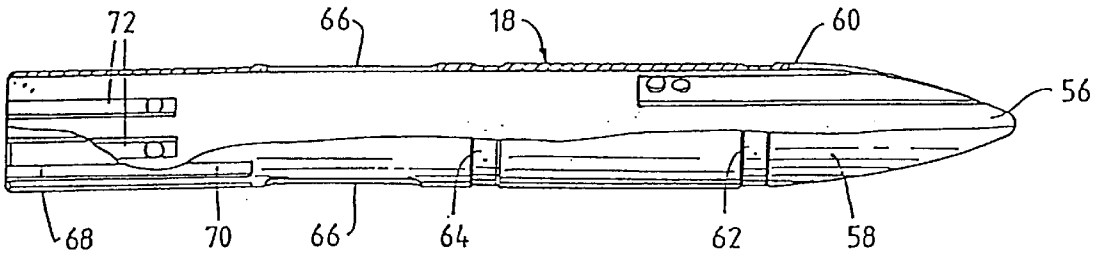
FIG. 7 is a longitudinal-sectional view of a bit locking sleeve of the system for in situ replacement of a cutting means shown in FIGS. 1–4.

Referring to FIG. 6, it can be seen that the drive sub 12 is composed of a lower section 20 and an upper section 22 which are threadingly coupled together. An upper end of section 22 is provided with a screw thread 24 for threadingly engage the core barrel 26. Moving in a downward direction from threaded end 24, it can be seen that inner circumferential surface 28 of the drive sub 12 is provided with a sequence of contiguous portions of differing diameter. Specifically, the inner circumferential surface 28 includes a first section 30 of a first diameter; a contiguous second section 32 of greater diameter; and a contiguous third section 34 of yet greater diameter. Step 35 is formed on the surface 28 at the boundary between the first section 30 and the second section 32. Section 34 extends to the end of the section 22 of the drive sub which, as previously mentioned, is threaded to lower section 20. Following the third portion 34 of the inner circumferential surface 28, is a fourth portion 36 of yet greater diameter which includes the screw thread for the section 20 of the drive sub 12 enabling connection with the section 22. Contiguous with a fourth portion 36 is a fifth portion 38 of smaller diameter than portion 36 but greater diameter than portion 34. Contiguous fifth portion 38 is contiguous with a stepped up (ie greater diameter) sixth portion 40. The inner surface 28 is next provided with a seventh portion 42 which is a step wise smaller diameter than the sixth portion 40. Contiguous with a seventh portion 42 is a tapered eighth portion 44 which progressively increases in diameter leading to ninth portion 46 which is of constant diameter and extends for a major length of section 20 and leads to a sequence of flat and tapered surfaces shown generally as item 48 which form part of a seat 50 for the bit segments 16. The seat 50 includes a circumferential land 49 for engaging the bit segments 16 and is completed by a series of circumferentially spaced drive lugs 52 provided about inner circumferential surface 28 at a lower most end of the drive sub 12. A series of circumferentially spaced apart splines 54 are bolted about the ninth portion 46 of the inner circumferential surface 28 of the drive sub 12.

The bit locking sleeve 18 (refer FIGS. 7 and 8) is in the form of a tube having a pair of peaks 56 (only one of which is shown) at an upper end 58. The peaks 56 are spaced apart and lead to a flat 60 disposed therebetween. The outer surface of the upper most part of peaks 56 is tapered radially inwardly so that that portion of the peaks 56 is spaced from the inner circumferential surface 28 (refer FIG. 2*c*). A first circumferential recess 62 is formed about the outer surface of the bit locking sleeve 18 below the land 60. Spaced from the recess 62 is a second circumferential recess 64 again formed about the outer surface of the bit locking sleeve 18. A pair of opposing slots 66 are cut through the locking sleeve 18 and extend in the direction of the length of the bit locking sleeve 18. The slots 66 are located below the second recess 64. Lower end 68 of the bit locking sleeve 18 is provided about its outer surface with a series of splines 70 and recess 72 which engage the splines 54 of the drive sub 12 to guide the travel of the locking sleeve 18. More particularly, each spline 70 is disposed between adjacent splines 54 with each spline 54 able to ride within a corresponding recess 72. This arrangement allows the bit locking sleeve 18 to slide along the inner circumferential surface 28 but prevents rotation of the bit locking sleeve.

Referring to FIGS. 1*a*–1*d* and 5, it can be seen that the tool 14 comprises a main body portion 74 and an outer sleeve 76 slidably mounted on the main body 74. An upper end of the main body 74 is threadingly connected via coupling 78 to a pivotal spear point 80. The spear point 80 is well known in the industry and facilitates coupling of the tool 14 to a running line (not shown). The main body 74 is itself composed of a first portion 82 and a second portion or head 84 which, as will be explained in greater detail below, are retractably coupled together. Housed within a cavity 86 of the main body 74 is a latching mechanism 88 known as "installation latch dogs". The installation latch dogs 88 essentially comprise a pair of arms 90 which are pivotally coupled together at one end by a pin 92 and biased by a spring 94 at an opposite end so as to extend from the outer surface 96 of the tool. Opposite ends of the pin 92 pass through respective slots 98 formed in the main body 74 and into diametrically opposed holes 100 formed in the outer sleeve 76. This provides a slidable connection between the outer sleeve 76 and main body 74 as, when outer sleeve 76 moves longitudinally relative to the main body 74, the pin 92 is able to slide within slots 98. Pin 92 is held in place by a snap ring 102 which is disposed within a circumferential recess 104 formed about the outer periphery of the outer sleeve 76. To assist in locating the snap ring 102 about the pin 92 opposite ends of the pin are also provided with grooves 106 within which the snap ring 102 can sit. Snap ring 102 is basically in the form of a metal wire ring which is resiliently expandable.

The end of the arms 90 (see FIGS. 1*c* and 2*c*) which extend from the cavities 86 are provided with a planar latching face 108 for engaging the lands 60 of the bit locking sleeve 18. A central part of the spring 94 is wound about a stud 110 which resides holly within the main body 74 and held at its opposite ends in diametrically opposed slots 112.

A second latching mechanism 114 (see FIGS. 1*b* and 2*b*) known as "retrieval latch dogs" are also located within the cavity 86. The retrieval latch dogs 114 comprise a pair of arms 116 which are disposed in the same plane as arms 90 of the installation latch dogs but are orientated in the opposite direction. The arms 116 are pivotally coupled together at a lower end about a pin 118 which threadingly engages and is wholly disposed within the main body 74. An opposite end of each arm 116 is biased by spring 120 so as to move out of the cavity 86 toward contact with an inner surface of the bit locking sleeve 18. A central part of the spring 120 is wound about and retained by stud 122. Opposite ends of the stud 122 are held within diametrically opposes slots 124 formed in the main body 14. The end of arm 116 opposite the pin 118 is provided with a latching face 125 for engaging respective slots 66 in the bit locking sleeve 18. Adjacent an end of the latching face 125 nearest the outer sleeve 76 is a bevelled face 126 which slopes away from the centre of the tool 74 in the direction toward pin 118. The bevelled face 126 then leads to a straight face 128 on the outer side of each arm 116 which in turn leads to a second bevelled face 130. A releasable pin 132 is provided which can pass through both the arms 116 to lock the retrieval latch dogs 114 in a substantially compressed state so as to be disposed within the confines of the main body 74. Pin 132 is held in place by a snap ring 133. This pin is inserted when the tool 14 is used in an installation mode to install the bit segments 16 into the drive sub 12, and removed when the tool 14 is in a retrieval mode for retrieving the bit segments 16 from the drive sub 12.

The lower end of the first portion 82 (see FIGS. 1*b* and 2*b*) of the main body 74 is formed with a tubular extension 134 which receives a spigot 136 extending from upper end of the second portion 84. A pin 138 extends transversely through the tubular extension 134 and resides within opposing slots 140 formed in the spigot 136 intermediate the length of the tubular extension 134. A pair of diametrically opposed holes 142 is formed in the tubular extension 134 for seating respective ball bearings 144. There is a stepped reduction in the internal diameter at the lower end of tubular extension 134 so as to form a cup-like structure 146.

A pair of diametrically opposed elongate slots 148 is formed in the spigot 136 below the holes 142. The slots 148 receive the ball bearings 144 but are of a width so as to allow only a portion of the ball bearings 144 to extend therethrough, preventing the ball bearings 144 from passing wholly therethrough. The elongation of slots 148 allows relative movement of the spigot 136 and tubular extension 134 to facilitate movement of the head 84 relative to the first portion 82 of the tool.

Figure 1A:
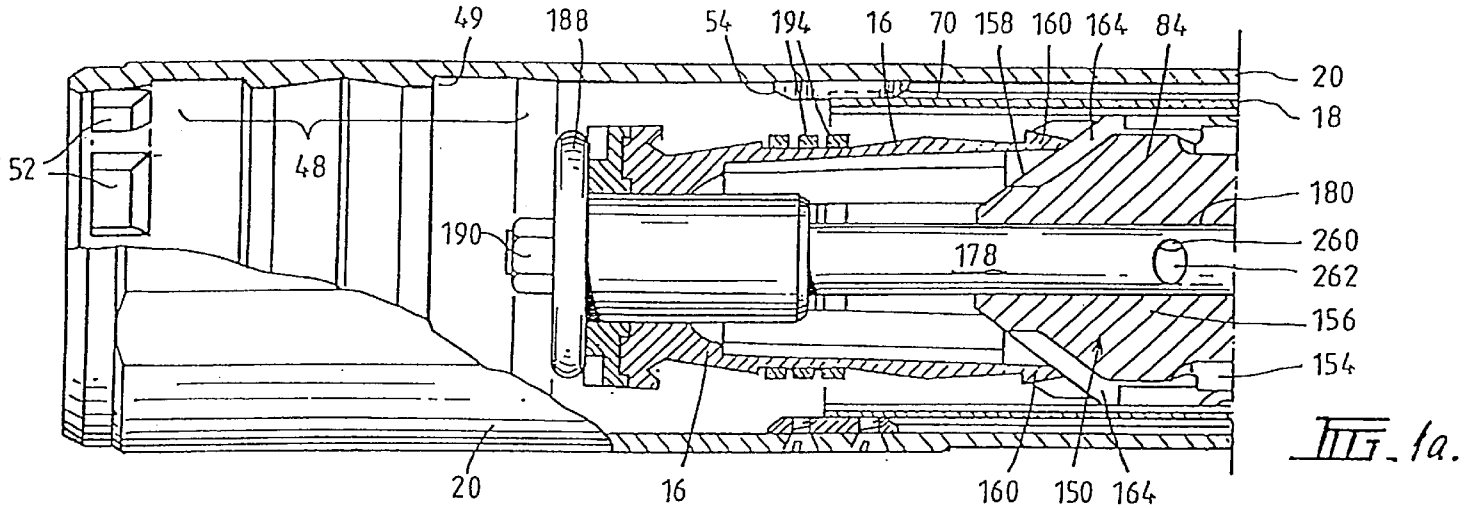
FIGS. 1*a*, 1*b*, 1*c* and 1*d* are longitudinal section side views taken on lines a—a, b—b, c—c and d—d on FIG. 1 of a system for in situ replacement of a cutting means for a ground drill in a state prior to the cutting means being locked to the ground drill and including an embodiment of the tool for transporting the cutting means to and from the ground drill.
Figure 1B:
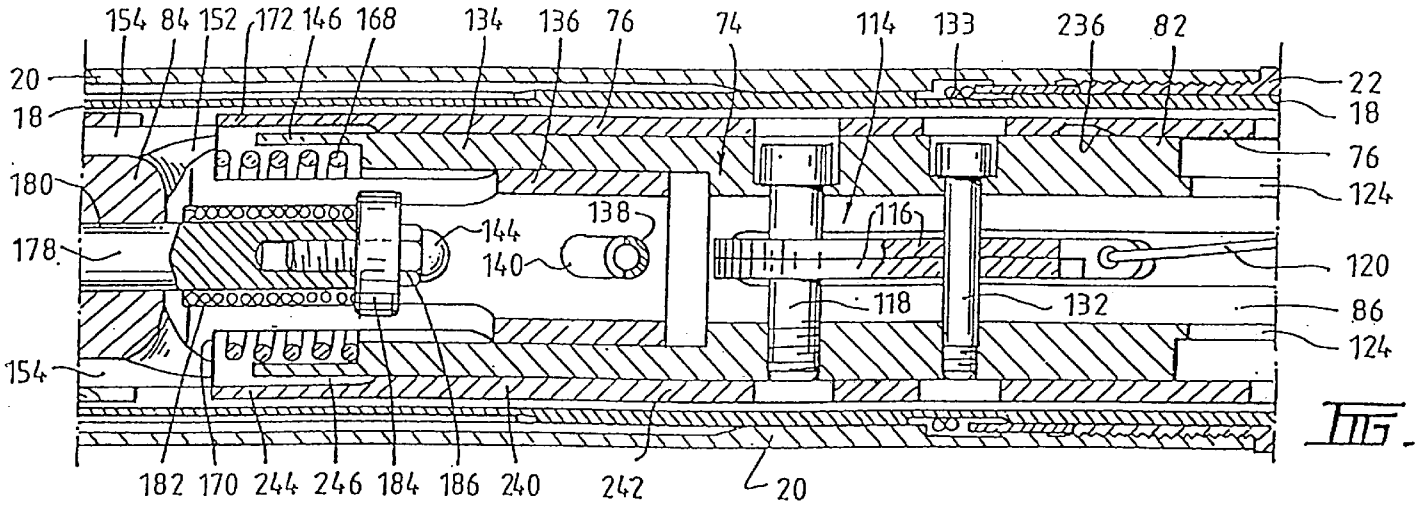
Figure 1C:
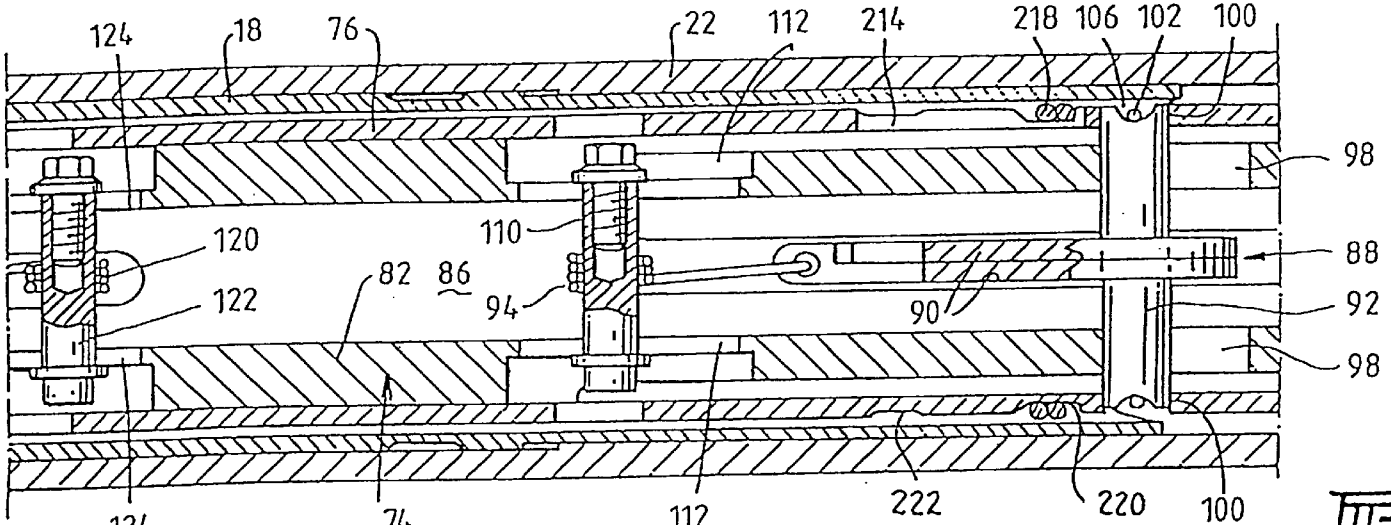
Figure 1D:
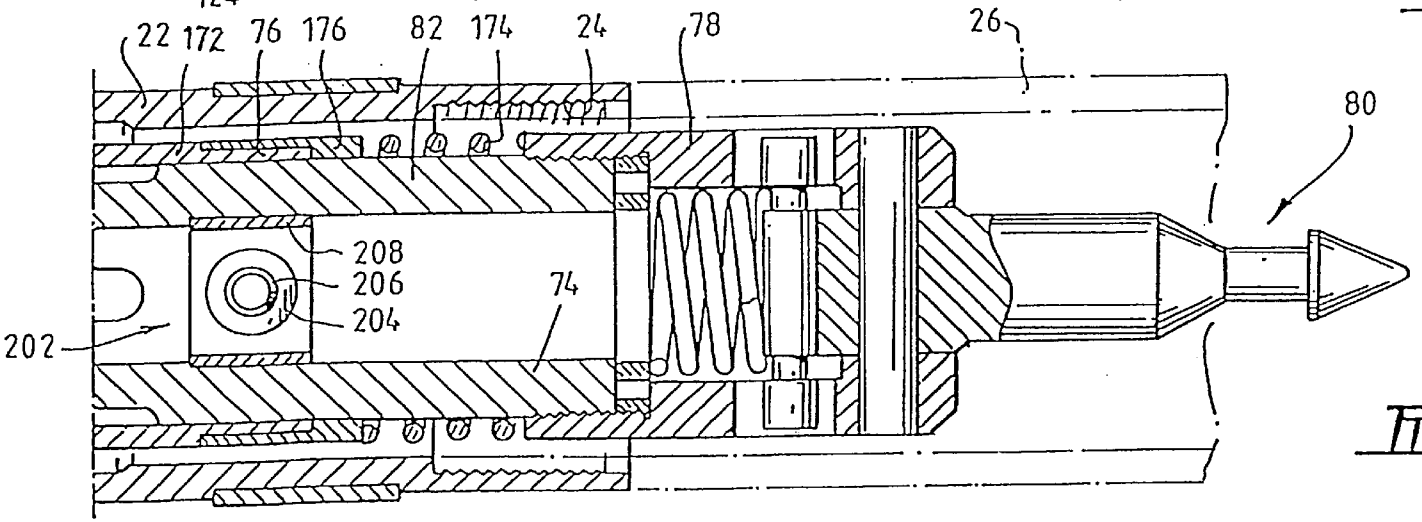
Figure 2A:
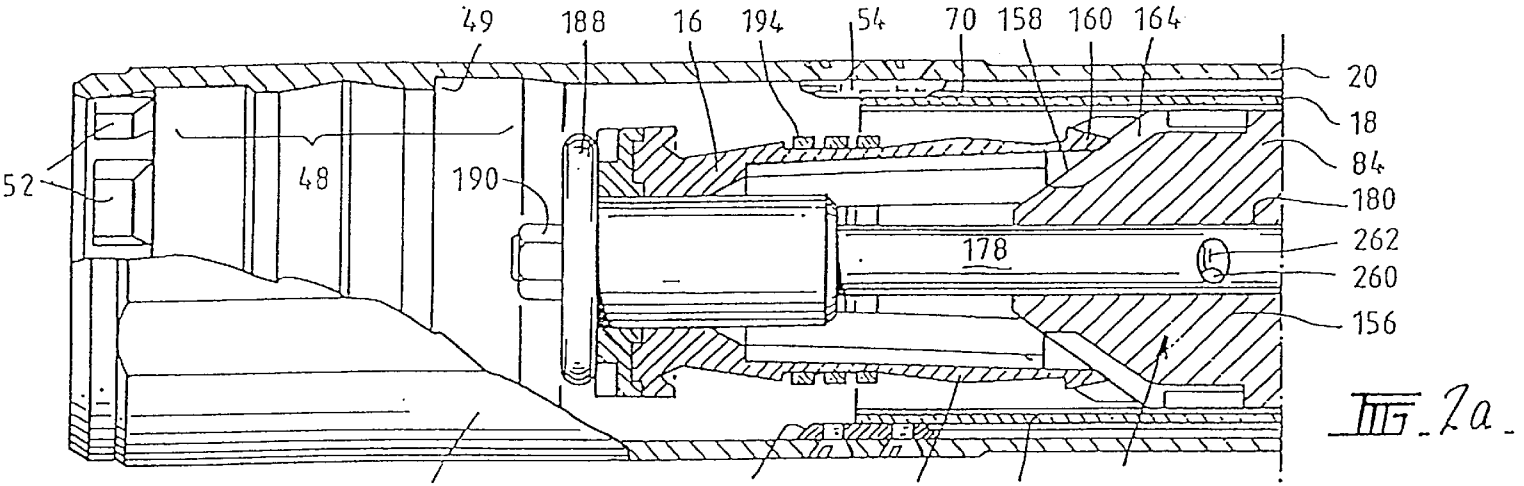
FIGS. 2*a*, 2*b*, 2*c* and 2*d* are sectional views of the system for in situ replacement of cutting means in the ground drill but with the longitudinal-section being in a plane rotated 90° to that of FIG. 1*a*, 1*b*, 1*c* and 1*d;*
Figure 2B:
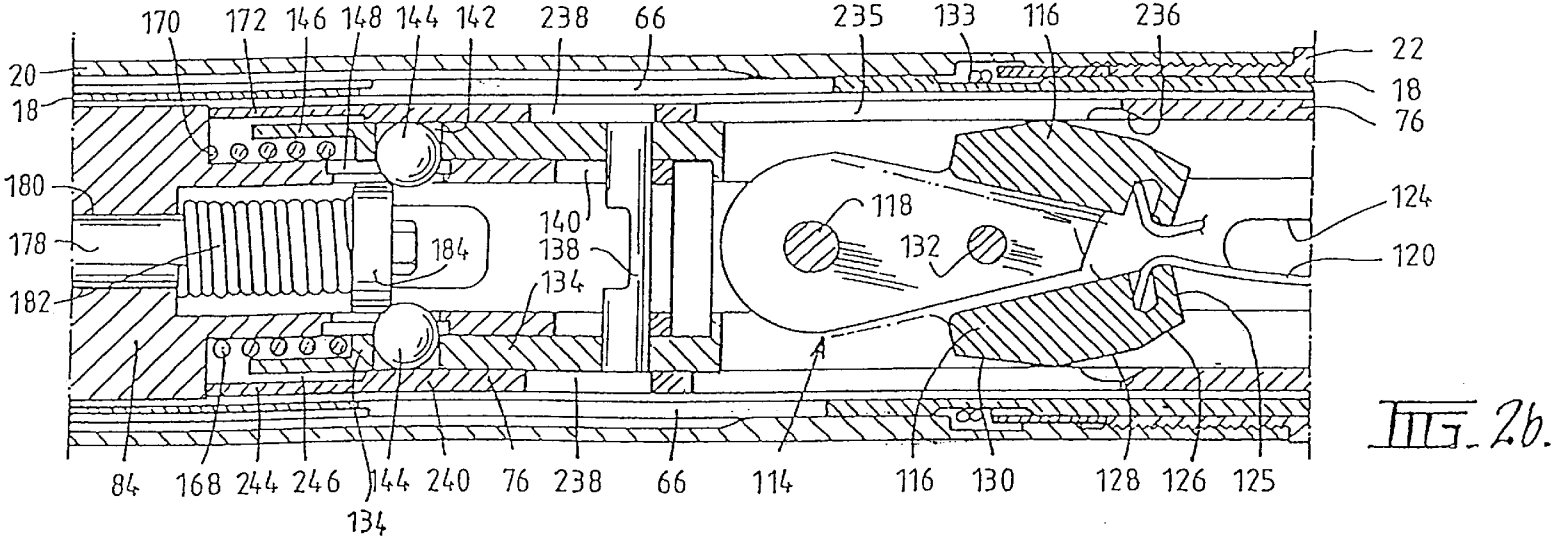
Figure 2C:
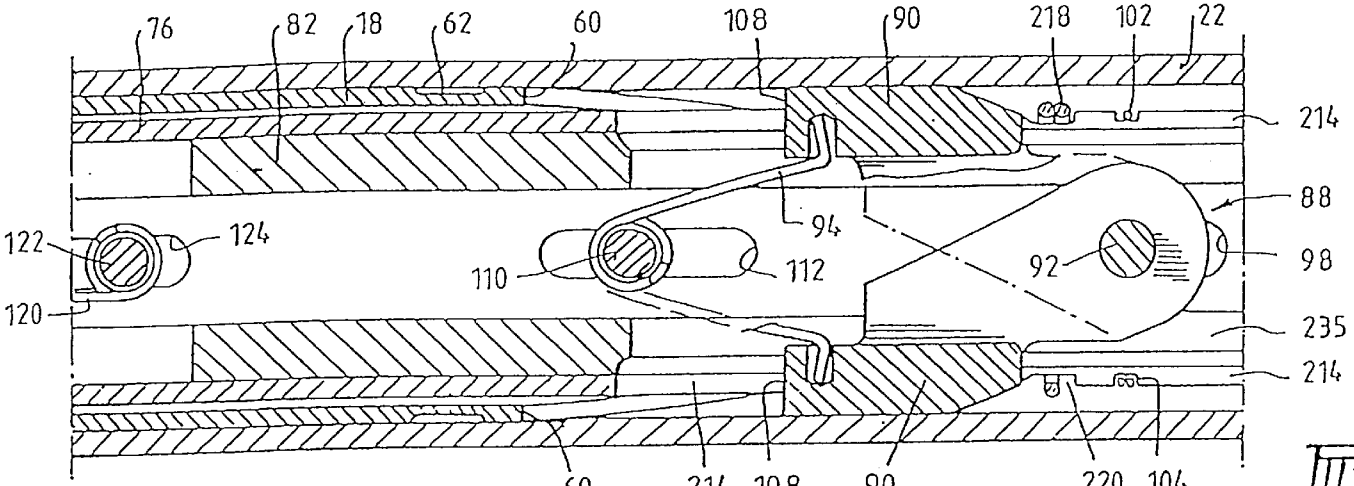
Figure 2D:
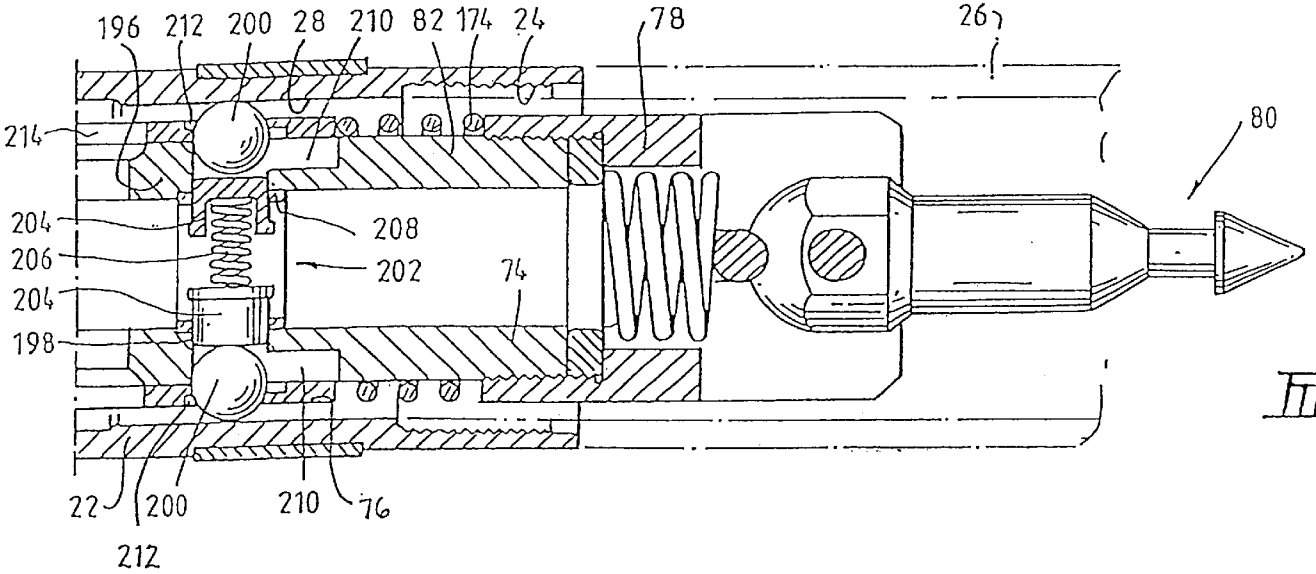
Figure 3A:
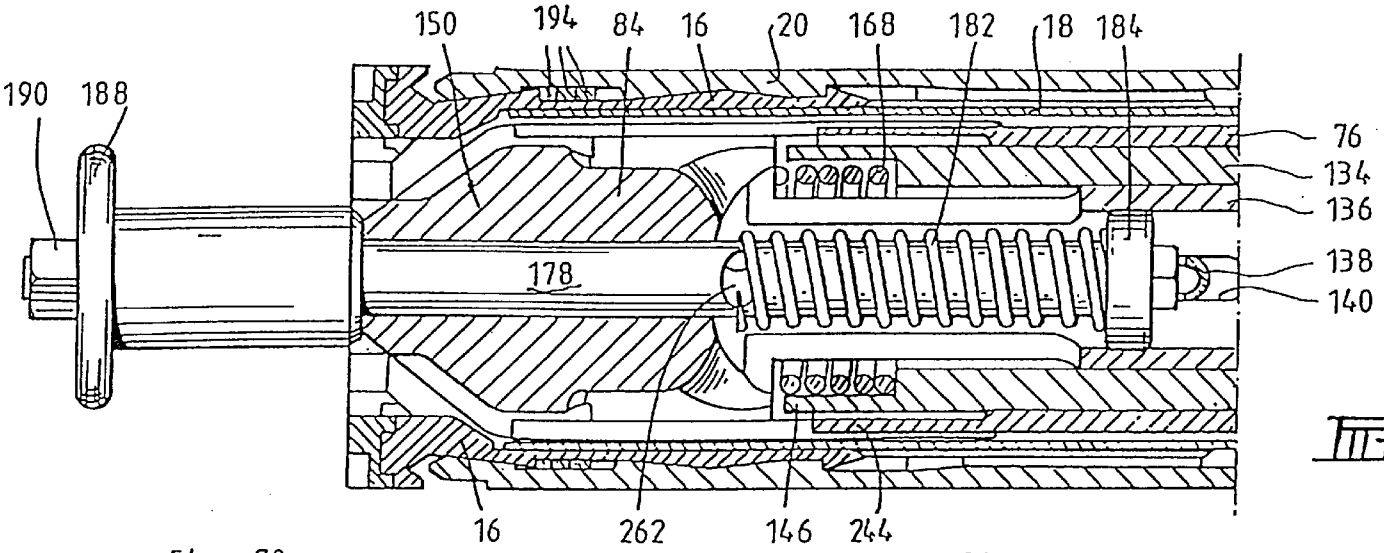
FIGS. 3*a*, 3*b*, 3*c* and 3*d* are longitudinal sectional side views of the system for in situ replacement of cutting means in a ground drill in the same plane as shown in FIG. 1*a*, 1*b*, 1*c* and*d* but with the system in a second state where the cutting means are locked to the ground drill.
Figure 3B:
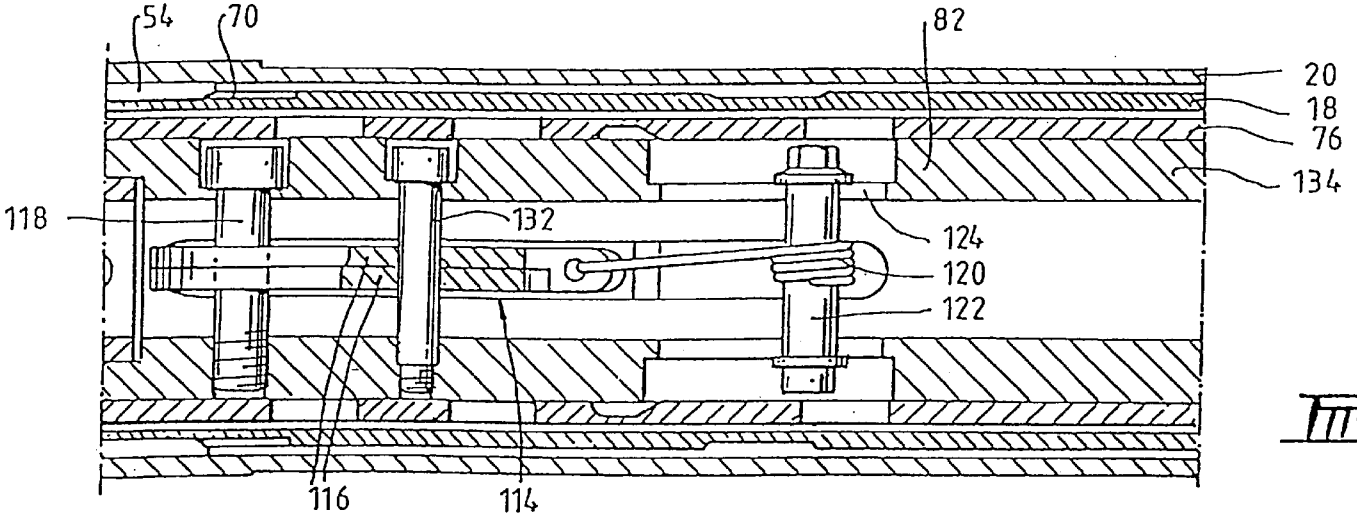
Figure 3C:
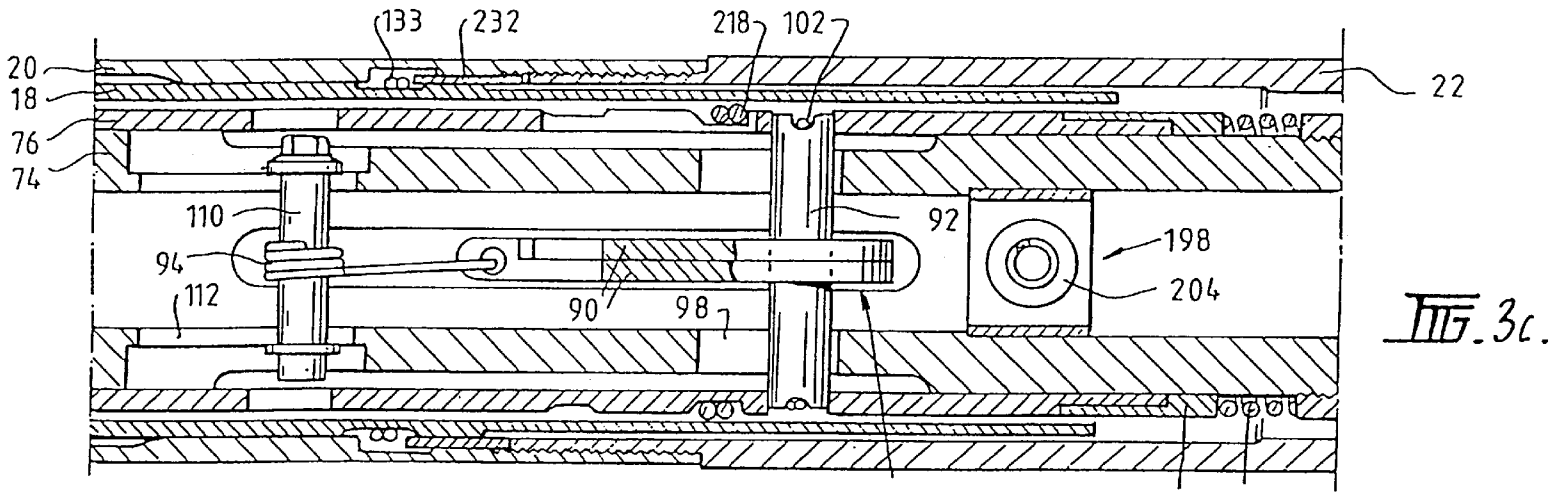
Figure 3D:
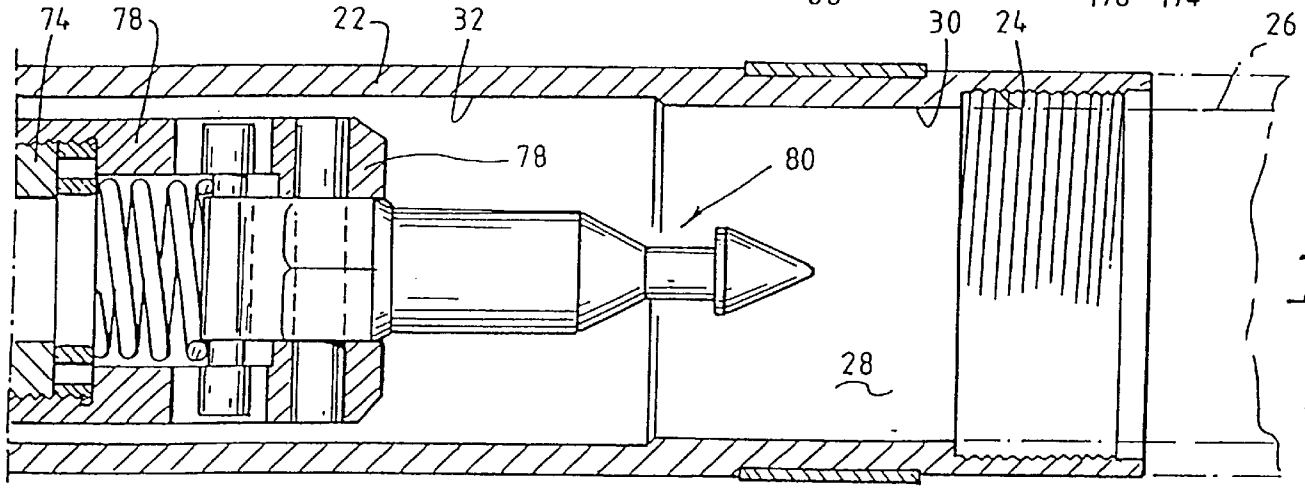
Figure 4A:
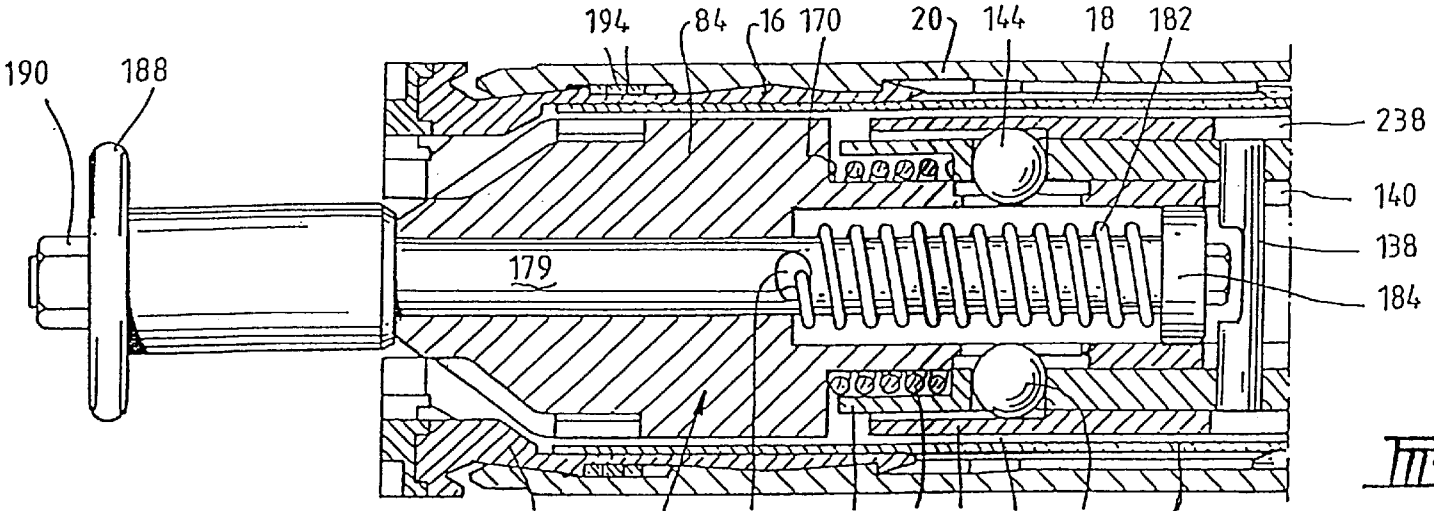
FIGS. 4*a*, 4*b*, 4*c* and 4*d* are views of the system shown in FIGS. 3*a*, 3*b*, 3*c* and 3*d* but in a sectional plane rotated 90° to that of FIGS. 3*a*, 3*b*, 3*c* and 3*d;*
Figure 4B:
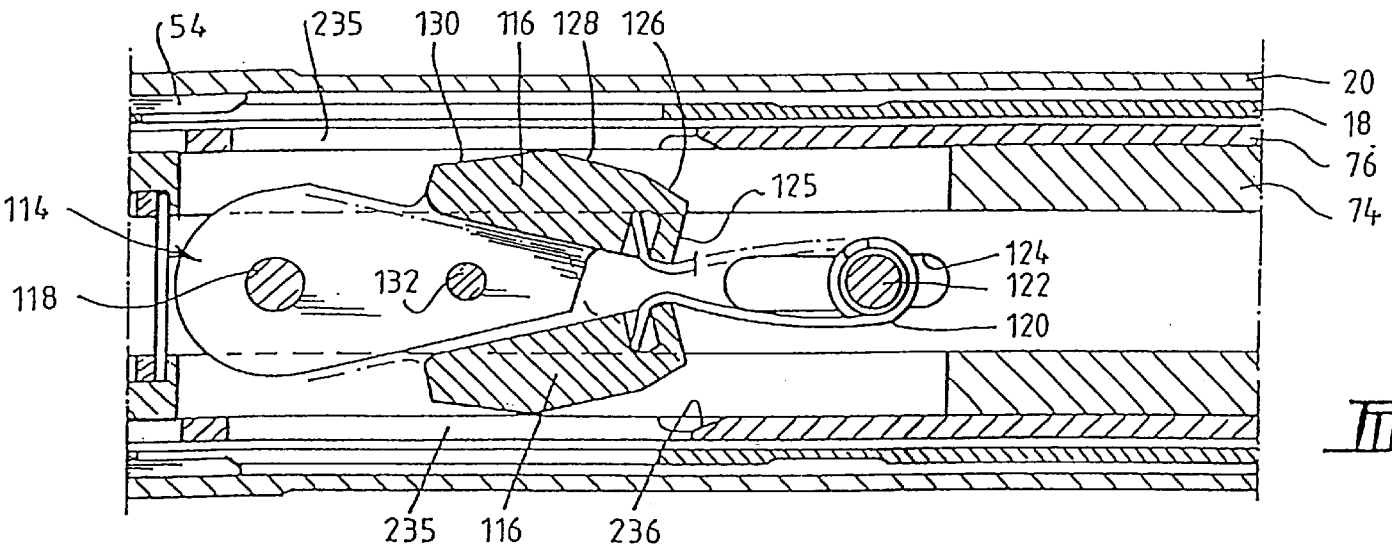
Figure 4C:
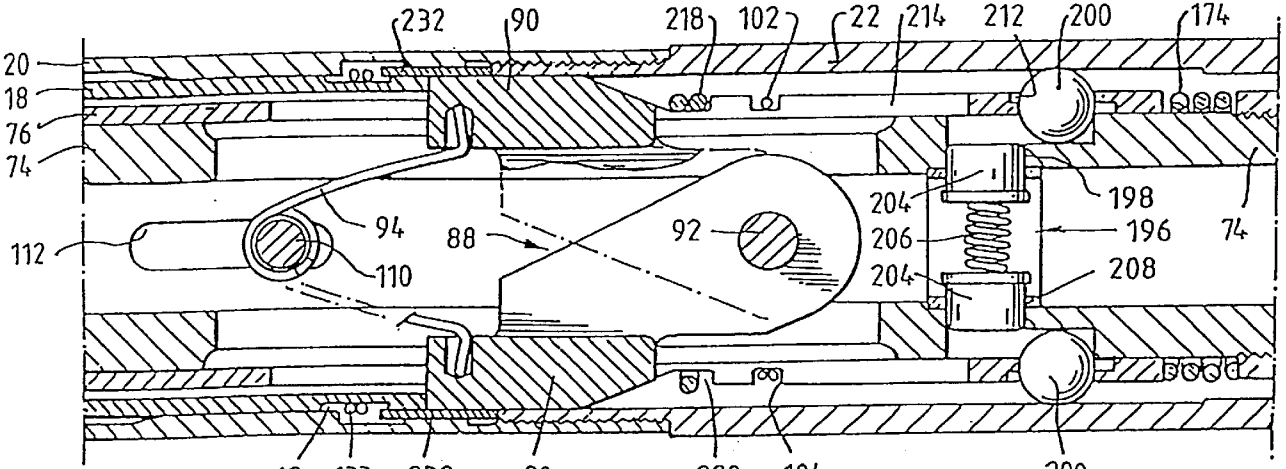
Figure 4D:
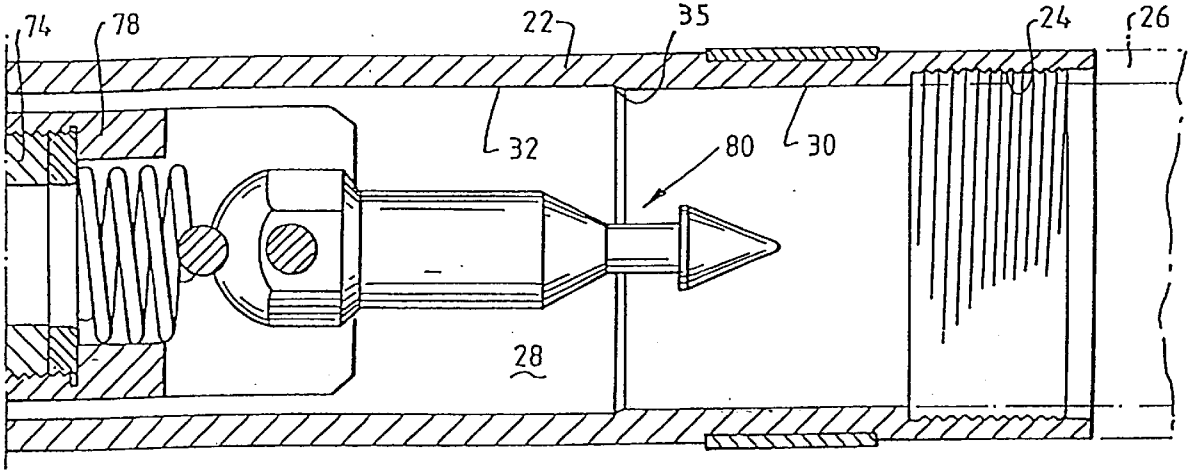

Referring to FIGS. 1*a*, 2*a* and 5, it is seen that on upper portion 150 of the head 84 is of a substantially cylindrical shape but has peripheral longitudinal channels 152 (refer FIG. 5) provided along the side thereof for allowing the flow of liquid such as water and drilling mud. Adjacent the upper portion 150 is an intermediate portion 154 of constant but reduced diameter. Contiguous with the intermediate portion 154 is a bottom portion 156 of substantially frusto-conical shape which narrows in the downward direction. A plurality of ramps 158 are disposed radially about the outer surface of the bottom portion 156 for seating an upper end 160 of the bit segments 16. Each ramp 158 is bound by opposing side walls 162 between which the upper ends 160 of the bits segments 16, lie. Longitudinal channels 164 are also formed centrally of each ramp 158 to allow the flow of water and drilling mud. Similarly, channels 166 are formed between adjacent side walls 162 of adjacent ramps 158 again to allow for the flow of water and drilling mud.

A spring 168 is disposed about the spigot 136 and has an upper end seated in the cup-like structure 146 and a lower end bearing against an upper face 170 of the upper portion 150 of the head 84. The spring 168 is biased so as to push the head 84 and first portion 82 of the tool apart in a longitudinal direction.

Lower end 172 of the sleeve 76 is also biased in a direction so as to contact the face 170 on the head 84. This bias is provided by a coil spring 174 disposed about an upper portion of the main body 74 between the coupling 78 and an upper end 176 of the sleeve 76.

Cradle 178 passes through an axial hole 180 formed in the head 84 so that an upper portion of the cradle 178 is disposed within the spigot 136. The purpose of the cradle 178 is to hold the bit segments 16 during transport to and from the drive sub 12 and, when installing the bit segments 16, to expand the upper end 160 of the bit segments radially outwardly so that they can be collected by the locking sleeve 18.

A coil spring 182 surrounds an upper end of the cradle 178 disposed within the spigot 136. The spring 182 is retained on the cradle 178 by a washer 184 fixed to the cradle 178 by a bolt 186. When the tool 14 is being used to install bit segments 16 into the drive sub 12 (as shown in FIGS. 1*a* to 1*d* and 2*a* to 2*d*) the cradle 178 is extended from the head 84 so as to compress the spring 182. Spring 182 is held in compression by the ball bearings 144 which engage an upper surface of the washer 184 through the longitudinal slots 148.

Disk-like flange 188 extending in a plane transverse to the axis of the tool 14 is attached by a nut 190 to the bottom end of the cradle 178. An upper face of the flange 188 acts as a bearing face for cutting face 192 formed at a lower end of the bit segments 16. The bit segments 16 are held circumferentially about the cradle 178 by three elastic bands 194 extending around the cradle 178 about the outer surfaces of the bit segments.

An upper end of the tool 14 is provided with a locking system 196 (see FIGS. 1*d*, 2*d* and 10) for selectively locking the outer sleeve 76 to the main body 74 preventing relative sliding motion. The locking system 196 includes a pair of diametrically opposed recesses 198 formed in the main body 74. The recess 198 are designed to capture locking members in the form of ball bearings 200. Disposed within the main body 74 is a biasing system 202 designed to act on the ball bearings 200 so as to force them radially outwardly. The biasing system 202 comprises a pair of cups 204 which are dimensioned so as to be able to slide within the recesses 198 and which between them retain a coil spring 206. The cups 204 and spring 206 are in turn disposed within a cylindrical casing 208 which extends transversely across cavity 86 in the main body 74 coaxially with the recesses 198. The casing 208 essentially seals the spring 206 from drilling fluids within which the tool 14 operates. A channel 210 extends from each recess 198 longitudinally along the outer surface of the main body 74. The channels 210 provide a race within which the ball bearings 200 may travel when they are able to escape their respective recesses 198.

The locking system 196 also includes a pair of diametrically opposed openings 212 of a diameter less then the maximum diameter of the ball bearings 200 and formed at an upper end of the outer sleeve 76. The ball bearings 200 are biased by the biasing system 202 so as to extend through the openings 212 and bear against the inner circumferential surface 28 of the drive sub 12.

Moving in the downward direction from the openings 212 the outer sleeve 76 is provided with a pair of diametrically opposed longitudinally extending slots 214 through which the arms 90 of the installation latch dogs 88 can extend. The arms 90 are biased to extend through the slots 214 by the spring 94.

Figure 9:
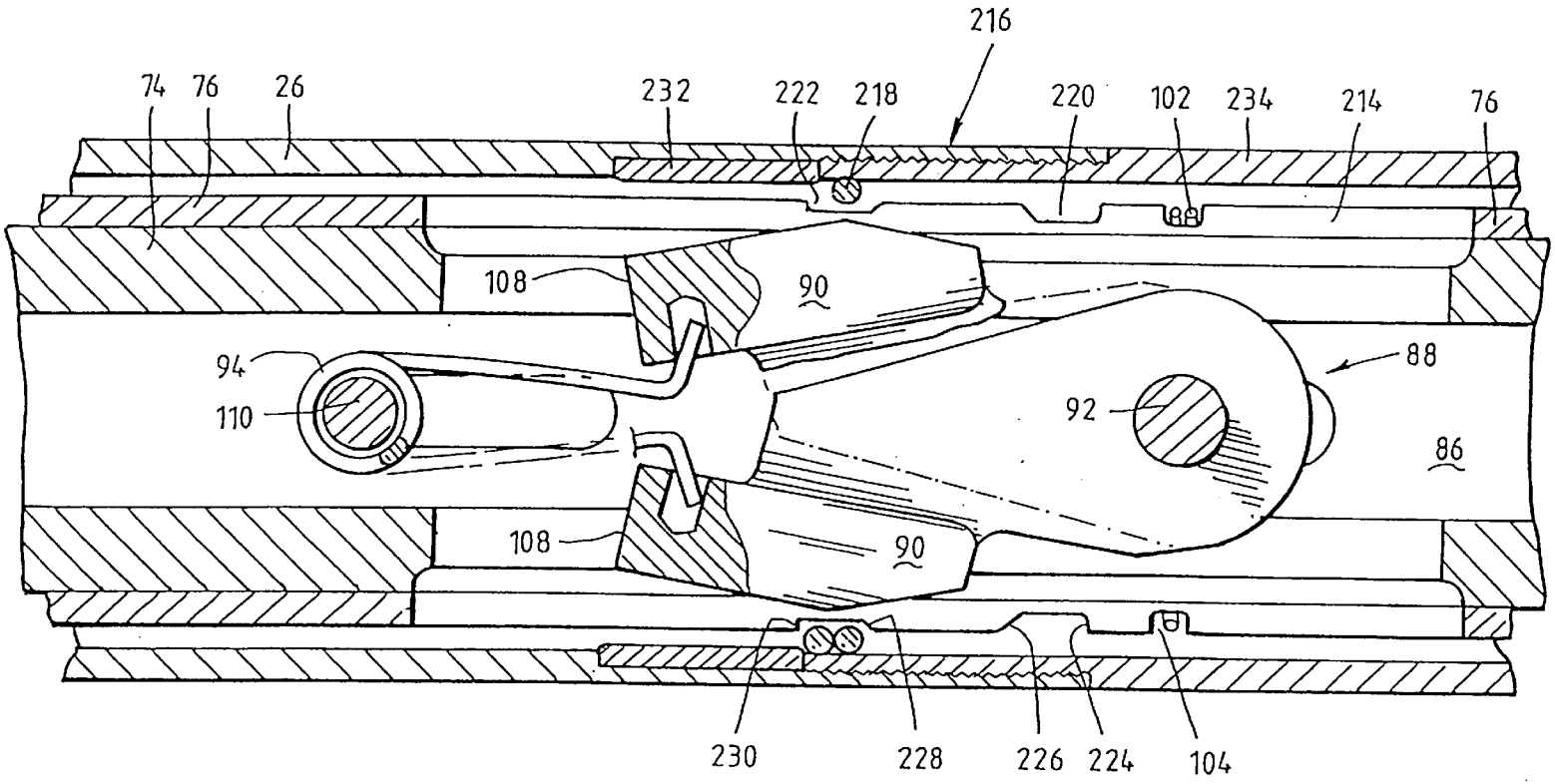
FIG. 9 is a longitudinal-sectional view of a portion of the system for in situ replacement of cutting means in the ground drill prior to passing through a landing ring of the ground drill.
Figure 10:
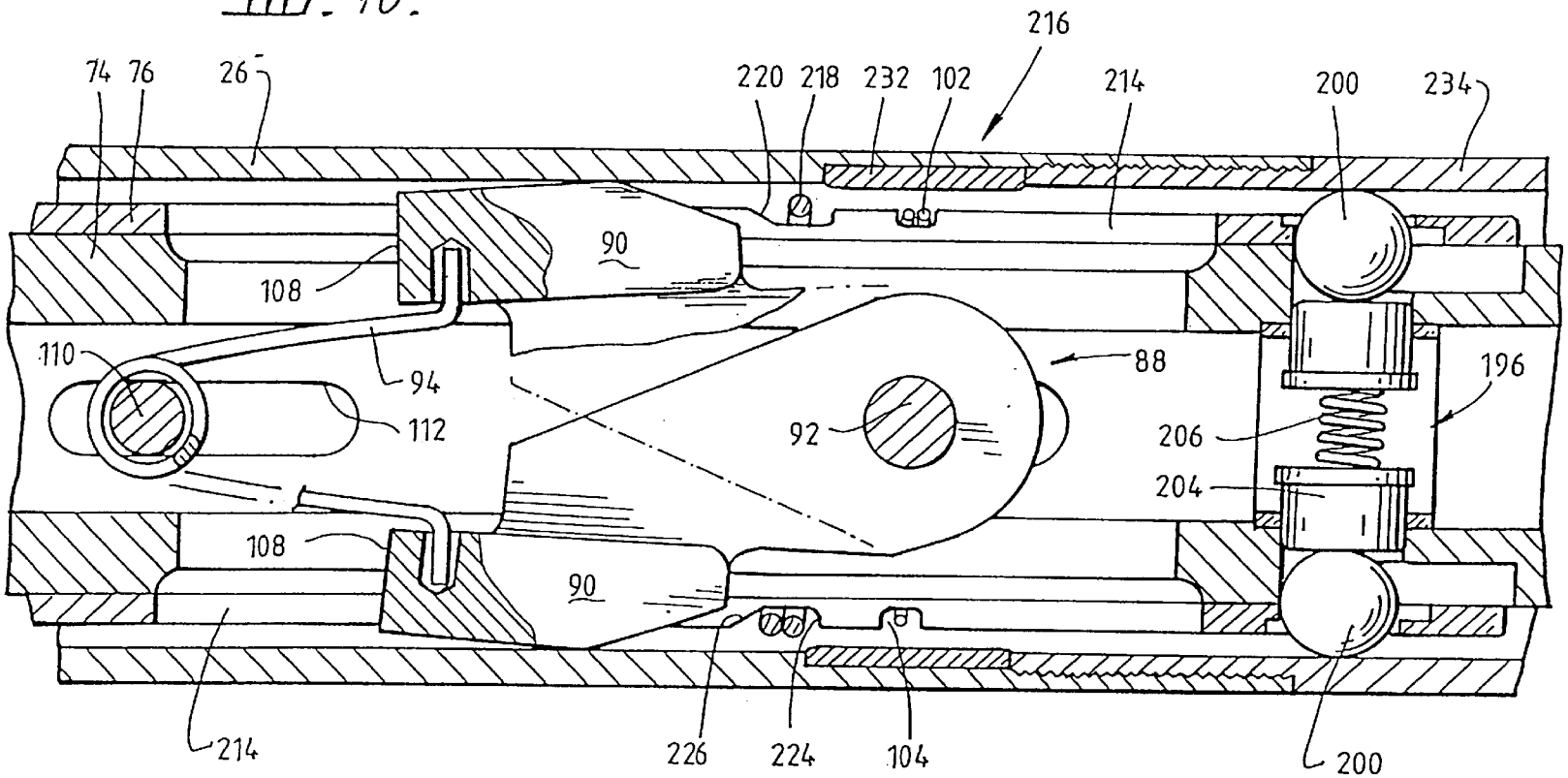
FIG. 10 illustrates the portion of the system for in situ replacement of cutting means in the ground drill shown in FIG. 9 after passing through the landing ring; and, FIG. 11 is a view of section E—E of the tool shown in FIG. 1.

As best seen in FIGS. 9 and 10, a compression system 216 is provided about the outer sleeve 76 and slots 214 for releasably retaining the installation latch dogs 88 within the confines of the outer surface of the tool 14. The compression system 216 includes a ring-like member in the form of a snap ring 218 which is adapted for location about the installation latch dogs 88. The snap ring 218 is able to be pushed or moved between two spaced apart grooves 220 and 222 to form circumferentially about the outer surface of the outer sleeve 76 and across the slots 214. The groove 220 takes the form of a substantially U-shaped channel having a substantially upright bank 224 at a side nearest the groove 104 and an opposing sloping bank 226 which is inclined away from groove 104.

Groove 222 is also in the form of a channel having a sloping bank 228 on the side nearest and sloping toward groove 220. An opposite side of the groove 220 has an upright bank 230. The groove 220 is deeper than groove 222. Also, the groove 220 is disposed about a portion of slots 214 through which the arms 90 do not extend while, groove 222 is disposed about a part of the slots 214 through which the arms 90 can extend.

The compression system 216, and more particularly the snap ring 218 is adapted to cooperate with a substantially stepped surface provided inside the drill pipe. This stepped surface is provided by a conventional landing ring 232 which is screwed into the ground drill between the core barrel 26 and drill pipe 234. When the tool 14 is being lowered through the drill pipe to transport the bit segments 16 to the drive sub 12, the installation latch dogs 88 are initially held in a relatively compressed state by the snap ring 218 located within groove 222 to ensure that the tool can pass through the landing ring 232. As shown in FIG. 9, when the snap ring 218 is in groove 220, the latching faces 108 of the arms 90 are disposed within the outer surface of the tool 14 so that they cannot engage the landing ring 232. However, the snap ring 218 has an upper portion which sits proud of the outer surface of the tool 14 and is contacted by and temporarily held against the landing ring 232. Due to the momentum of the tool 14 it continues to move in a downward direction and the snap ring 218 is expanded radially outwardly against the sloping banks 228 as t he tool continues its downward movement. When the snap ring 218 is knocked out of the groove 222, the a arms 90 a re able to expand from the slots 214 by action of the spring 94 (refer FIG. 10). With the tool continuing to move in the downward direction, the groove 220 eventually underlies the snap ring 218 and, due to the resilient expansion of the snap ring 218, it can then compress into the groove 220 as shown in FIG. 10. The groove 220 is of a depth such that when the snap ring 218 is located therein, it is able to pass through the landing ring 232.

A second pair of longitudinally extending slots 235 (see FIGS. 2*b*, 4*b* and 5) extending collinearly with and disposed below the slots 214 is provided in the sleeve 76 for allowing the retrieval latch dogs 114 to expand therethrough and contact the inner surface of the locking sleeve 18. An upper end of each slot 235 is provided with a bevel 236 formed between the radially inner and radially outer circumferential surfaces of the sleeve 76 which, when looking g in the upward direction, slope in a mutually converging manner.

As will be explained in greater detail below, the combination of the slots 235 formed in the sleeve 76 and the spring 174 co-act to form a retraction system for retracting the retrieval latch dogs into the cavity 86 during extraction of the tool 14 after retrieving a set of bit segments 16 from m the drive sub 12.

Below the slots 235 in the outer sleeve 76 is a pair of elongated holes 238 which allow access to the pin 138 for removal and installation. By removing the pin 138, the head 84 can be detached from the first portion 82 of the too 114 for serving and maintenance.

A lower portion 240 (see FIGS. 1*b* and 2*b*) of the outer sleeve 76 near the end 172 fits over the tubular extension 134 of the main body portion 82. An upper length 242 of the lower portion 240 has an internal diameter arranged so that when the upper length 242 is located over the holes 142, it pushes the ball bearings 144 through the underlying slots 148 so as to be able to contact the washer 184. However, a lower length 244 of the lower portion 240 has increased in the diameter so as to provide a gap 246 between the outer circumferential surface of tubular extension 134 and the inner circumferential surface of the lower length 244. As explained in greater detail below, when the outer sleeve 76 slides backwardly relative to the main body 74, the ball bearings 144 are able to move into the gaps 246 out of contact with the washer 184 to allow expansion of the spring 182 and subsequent retraction of the cradle 178 into the head 84.

Figure 8:
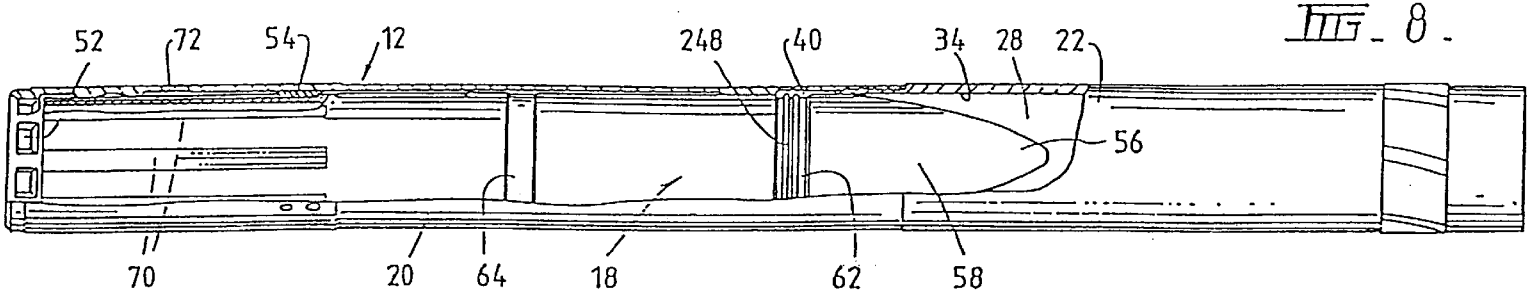
FIG. 8 is a longitudinal-sectional view of the bit locking sleeve of FIG. 7 disposed within the drive sub of FIG. 6.

FIG. 8 shows the bit locking sleeve 18 in an installation position. As previously mentioned the bit locking sleeve 18 can be moved between the retrieval position shown in FIGS. 1*a* to 1*d* and 2*a* to 2*d* and an installation position as shown in FIGS. 3*a* to 3*d*, 4*a* to 4*d* and 8, by the tool 14. As shown in FIG. 8 the bit locking sleeve 18 is held in the installation position by a snap ring 248 located in a void between the first recess 62 and the sixth portion 40 of the inner circumferential surface 28 of the drive sub 12. Snap ring 248 is always maintained within the sixth portion 40. When the bit locking sleeve 18 is pulled to the retrieval position by the tool 14, the snap ring 248 expands out of recess 62 and subsequently collapses into the second recess 64 holding the locking sleeve in this position until the tool 14 is again lowered to insert new bit segments 16, (as shown in FIGS. 1*a* to 1*d* and 2*a* to 2*d*).

A self centering system 249 for centering the tool 14 within the locking sleeve 18 as shown generally in FIG. 11. The self centering system is disposed circumferentially about the tool 14 in a transverse plane taken through upper portion 150 of the head 84. The self centering system is provided with a plurality, in this case four, centering elements in the form of metal balls 250 such as used in ball bearings, equally spaced about the circumference of the tool 14. Each ball 250 is seated in a corresponding cavity 252 formed about the periphery of the upper portion 150. The cavities 252 are closed by a threaded cap 254 which has a central opening through which a ball 250 can extend. However, the diameter of the opening is less than the diameter of the ball thereby preventing the ball 250 from falling out of the cavity 252. Balls 250 are resiliently retained within the cavities 252 by a pad of resilient material 256 disposed beneath each ball so as to force the ball radially outwardly. Due to the resilience of the pads 256, the balls are able to move radially between a first position lying on an imaginary circle subscribed about the head 84 having a diameter equal to or greater than the inner diameter of the locking sleeve 18 and a second position substantially flush with the outer surface of upper portion 150. That is, in the first position the balls 250 extend from the outer surface 150 and contact the inner surface of the bit locking sleeve 18. In the second position the balls 250 are pushed toward the centre of the tool 14. The pads 256 are of a resilience such that when the tool 14 is within the sleeve 18 both lying in a horizontal plane, the pads can support the weight of the tool or at least the head of the tool to ensure substantial centering of the tool within the locking sleeve 18.

Although not shown, a substantially identical centering system can be provided about the midlength of the tool 14. In this instance, slots will be required along the outer sleeve 76 in order to provide for the required relative sliding motion of the outer sleeve 76 and main body 74 during the operation of the tool 14.

As explained in greater detail below, when the tool 14 is used to retrieve bit segments 16 it is necessary to lock the cradle 178 in an extended position. This is achieved by removing pin 132 from the retrieval latch dogs and inserting it through cradle locking hole 260 formed through the intermediate section 154 of the head 84. The cradle 178 is also provided with a hole 262 for alignment with the locking hole 260 through which the pin 132 can pass. Pin 132 is held in place by the snap ring 133 placed about the outer periphery of the intermediate section 154.

The operation of the system 10 will now be described.

When initially installing segments 16 in the drive sub 12, the ball bearings 200 are located within the recesses 198, the cradle 178 extended from the head 84 so that the spring 182 is compressed and locked in a compressed state by the abutment of the ball bearings 144 with the washer 184, and the bit segments 16 loaded on the cradle 178 and held in place by the rubber bands 194. The installation latch dogs 88 held in a relatively compressed state by the snap ring 218 being disposed within the groove e 222 (as shown in FIG. 9). As the retrieval latch dogs 114 play no part in the installation of the bit segments 16, they are also locked in a relatively compressed state by pin 132 and corresponding snap ring 133. The bit locking sleeve 18 is held in the retrieval position by snap ring 248 residing in a void between the second recess 64 and the sixth portion 40 of the inner circumferential surface 28 of the drive sub 12. The tool 14 is lowered through the drill pipe by a wire line attached to the spear point 80. The ball bearings 200 are held within the recesses 198 against the inner circumferential surface of the drill pipe, thereby locking the outer sleeve 76 against sliding relative to the main body 74, this prevents accidental or premature firing of the cradle 178.

Referring to FIGS. 9 and 10, as the tool 14 passes through the landing ring 232, the snap ring 218 held initially within the groove 222 is pushed along the outer sleeve 76 to snap back into the groove 220. When in this groove, the snap ring 218 radially compresses so as to pass through the landing ring 232. The ball bearings 200 are also able to pass through the landing ring 232 by being compressed further into their recesses 198 against the bias of the spring 200.

Latching faces 108 of the installation latch dogs 88 contact the peaks 56 of the locking sleeve 18 causing the tool 14 to rotate about its longitudinal axis. This correctly orientates the bit segments 16 with the seat 50 and in particular drive lugs 52. As the tool continues to move downwardly, but prior to engagement of the latching faces 108 with the lands 60 of the bit locking sleeve 18, the ball bearings 200 enter the second portion 32 of the inner circumferential surface 28 of the drive sub 12. The second portion 32 has a greater inner diameter than portion 30 immediately above it, and therefore by action of the bias applied by spring 206, the ball bearings 200 are lifted out of their recesses 198 by the spring 206. Indeed, the spring 206 pushes the cups 204 to a position so that the surface thereof immediately below the ball bearing 200 is substantially coplanar with the channel 210. At this point, the sleeve 76 and main body 74 are decoupled to the extend that the sleeve 76 is now able to slide relative to the main body 74.

The tool 14 then continues its downward travel until the latching faces 108 engage the lands 60 of the locking sleeve 18. This contact causes the main body 74 to continue to move forward relative to the sleeve 76 compressing the spring 174. Also, the ball bearings 144 move into the gap 246 between the lower length 244 of the outer sleeve 76 and the outside of the cup-like structure 146 of the portion 82 (refer FIGS. 3 and 4). The ball bearings 144 can now be pushed radially outwardly by the backward bias supplied to the washer 284 by the compressed spring 182. This frees the spring 182 to expand retracting the cradle 178 into the head 84. As a result, upper ends 160 of the bit segments 16 slide along the ramps 158 of the head 84 so as to extend laterally from the tool. The ends 160 are collected by the lower end of the bit locking sleeve 18 which moves behind the bit segments 16 and spreads the bit segments radially outwardly. The locking sleeve 18 moves in this manner by virtue of the continued downward movement of the tool 14 which by its latch dogs 88 engage the bit locking sleeve 18 pushing it downwardly.

While the tool 14 is in the bit locking sleeve 18, or at least the head 84 is in the bit locking sleeve 18, the self-centering system 249 maintains the tool 14 substantially centered in the sleeve 18, irrespective of the inclination of the drive sub or bit locking sleeve 18.

The bit segments 16 engage the seating land 49 preventing any further downward movement thereof. The head 84 of the tool is prevented from falling at the bottom of the drive sub 12 by virtue of abutment with a stop in the form of a radially inner surface of the bit segments 16. However, the first portion 82 of the main body 74 is still able to travel a short distance due to the nature of the coupling between the head 84 and the first portion 82. As seen most clearly in FIGS. 1*b* and 2*b*, a gap exists between the surface 170 and the end of the cup-like structure 146. The first portion 82 is able to continue moving in the downward direction by a distance equal to that gap. In effect, the head 84 retracts into the first portion 82. This retraction allows the tool 14 and in particular, the first portion 82 to push the bit sleeve 18 fully home onto a landing seat formed by the inner surfaces of the bit finger 16.

With the bit segments 16 now installed in the cutting position, the tool 14 can be pulled upwardly and retracted from the drive sub 12 and drill string.

In order to retrieve the segments 16 for replacement, the snap ring 133 and pin 132 which maintain the retrieval latch dogs 114 in a compressed state are removed. This allows the retrieval latch dogs 114 to move in an outward direction in compliance with the bias supplied by the spring 120. However, the pin 132 is now reinserted into the cradle locking hole 260 so as to lock the cradle 178 in a fully extended position. Of course, as it is now desired to retrieve the bit segments 16, no bit segments are initially located onto the cradle 178 when lowering the tool 14 into the drill pipe. The remaining configuration of the tool remains the same as for when installing the bit segments 16. As the tool is passed through the landing ring 232, the snap ring 218 is moved from groove 222 to groove 220 allowing the installation latch dogs to extend from the slots 214. Again, the installation latch dogs 88 contact the peaks 56 causing the tool 14 to rotate so as to correctly orientate the bit 84 and cradle 176 to receive the bit segments. Additionally, when the ball bearings 200 enter the second portion 32 of the inner surface of the drive sub 12, they are moved out of their respective recesses 198 and are able to then ride along the channels 210 facilitating relative sliding motion of the outer sleeve 76 and main body 74. When the tool 14 has bottomed out with the head 84 abutting the inner surfaces of the bit fingers 16, the retrieval latch dogs 114 extend through slots 235 in the outer 76 and into the slots 66 of the locking sleeve 18. When in this configuration, the bevelled face 126 of each arm 116 also bears against the ninth portion 46 of the inner circumferential surface of the drive sub 12.

As the tool 14 is now pulled upwardly by a wire line attached to the spear point 80, the latching faces 125 engaged in the slots 66 pull the locking sleeve 18 upwardly thereby releasing the bit segments 16. The bit segments 16 collapse onto the cradle 178 by action of the rubber bands 194.

In order to now fully withdraw the tool 14 and bit segments 16, the retrieval latch dogs 114 must now be disengaged from the slots 66 of the bit locking sleeve 18. This is achieved by a retraction system which includes the inner surface 28 of the drive sub 12 as well as the slots 234 of the outer sleeve 76. In particular, as the tool 14 is being dragged upwardly, the bevelled faces 126 and flat faces 128 contact the sloping ninth portion 44 of the inner surface of the drive sub 12 which pushes the arms inwardly toward each other. At the same time, the spring 174 is pushing the outer sleeve 76 in a downward direction. The arms 116 are pushed inwardly by the sloping ninth portion 44 inner surface of the drive sub 12 to an extent such that the bevelled faces 126 can be bought into contact with the bevels 236 at the top of the slots 235. The force of the spring 174 and the relative configuration of the bevelled face 126 and bevels 236 pushes the outer sleeve 76 over the retrieval latch dogs disengaging them from the bit locking sleeve 18.

If for some reason the outer sleeve 76 cannot be pushed by the spring 174 alone over the retrieval latch d dogs, upon continued upward pull on the tool 14, the ball bearings 200 engage the step 35 at the boundary between the first and second surface portions 30 and 32 of the drive sub 12 and maintain the sleeve 76 in a static position while rolling along channels 214. Accordingly, the force of the pull on the tool 14 is transmitted to the outer sleeve 76 to push it over the retrieval latch dogs 114. The ball bearings 206 then collapse into their recesses 198 compressing the spring 200 so as to allow full retraction of the tool 14.

The tool can then be withdrawn from the drill string, the bit segments 16 taken off the cradle and a fresh set of bit segments 16 loaded on to the cradle for installation into the drive sub.

Now that an embodiment of the tool has been described in detail it will be apparent to those skilled in the relevant arts that numerous modifications and variations may be made with out departing from the basic inventive concepts. For example, the coupling between the head d 84 and first portion 82 may take other forms other than that of a spigot 136 received within a tubular extension 134 provided that the coupling allows sliding motion of one part of the main body of the tool relative to another part. Additionally, a biasing element other than a spring 168 may be used for biasing the parts apart.

All such modifications and variations are deemed to be within the scope of the present invention the nature of which is to be determined from the foregoing description and the appended claims.

The claims defining the invention are as follows:

1. A tool for transporting bit segments to and from a drive sub of a ground drill and for moving a bit locking sleeve held within the drive sub to an installation position in which the bit locking sleeve locks the bit segments against an inner surface of the drive sub, said tool further adapted to cooperate with stopping means disposed within said drive sub for stopping the travel of said tool in a first direction, the tool comprising:

a first portion;

a second portion retractably coupled to a lower end of said first portion; and, means carried by said first portion, for engaging said bit locking sleeve;

wherein, when said tool travels in said first direction, said engaging means initially engages said bit locking sleeve to move said bit locking sleeve toward said installation position and, on further travel in said first direction, a leading end of said tool engages said stopping means to halt travel of said leading end, causing one of the first and second portions to begin retracting into an other of the first and second portions, enabling further movement of the first portion in the first direction so that said engaging means moves said bit locking sleeve fully into said installation position.

2. A tool according to claim 1, wherein said first and second portions are resiliently coupled together so that after initial retraction of one of said first and second portions into the other of the first and second portions, the first and second portions are urged to move away from each other to restore said tool to an equilibrium state.

3. A tool according to claim 2, wherein an upper end of said second portion is connected to the lower end of said first portion to allow relative movement of said first and second portions in the direction of the length of said tool.

4. A tool according to claim 3, wherein said first and second portions are provided with respective abutment surfaces adapted to abut each other when said tool hits said stopping means and said one portion retracts into said other portion by a predetermined distance thereby limiting the further movement of said first portion in said first direction.

5. A tool according to claim 4, wherein said first portion at said lower end is provided with a first member and said second portion at said upper end is provided with a second member, said members being relatively dimensioned so that one of said members fits and slides within the other member so as to allow one of said portions to retract into the other portion.

6. A tool according to claim 5, wherein one of said members is provided with at least one slot which is elongated in the first direction and further comprising means for coupling said first and second portions together, which is coupled to the other member and extends into said at least one slot thereby coupling said first and second portions together.

7. A tool according to claim 6, further comprising a resilient means retained between said first and second portions acting so as to push said first and second portions away from each other.

8. A tool according to claim 7, wherein said resilient means is retained in a recess formed between said first and second members.

9. A tool according to claim 8, wherein said first member is tubular in form and said second member slidingly fits within said first member.

10. A tool according to claim 9, wherein a longitudinal portion of at least one of an interior surface of said first member and an exterior surface of said second member is cut out to form said recess for retaining said resilient member.

11. A tool for transporting bit segments to and from a drive sub of a ground drill and for moving a bit locking sleeve held within the drive sub to an installation position in which the bit locking sleeve locks the bit segments against an inner surface of the drive sub, said tool further adapted to cooperate with stopping means disposed within said drive sub for stopping the travel of said tool in a first direction, the tool comprising:

a first portion;

a second portion retractably coupled to a lower end of said first portion, wherein said first and second portions are resiliently coupled together so that after initial retraction of one of said first and second portions into the other of the first and second portions, the first and second portions are urged to move away from each other to restore said tool to an equilibrium state; and, means carried by said first portion, for engaging said bit locking sleeve; wherein, when said tool travels in said first direction, said engaging means initially engages said bit locking sleeve to move said bit locking sleeve toward said installation position and, on further travel in said first direction, a leading end of said tool engages said stopping means to halt travel of said leading end, causing one of the first and second portions to retract into an other of the first and second portions, enabling further movement of the first portion in the first direction so that said engaging means moves said bit locking sleeve fully into said installation position.

* * * * *